US008763936B2

(12) United States Patent
Swenson et al.

(10) Patent No.: US 8,763,936 B2
(45) Date of Patent: Jul. 1, 2014

(54) NOZZLE ASSEMBLY AND METHODS RELATED THERETO

(75) Inventors: Jennifer Swenson, Anderson, IN (US); Edward McKenna, Gainesville, FL (US)

(73) Assignee: Terronics Development Company, Elwood, IN (US)

( * ) Notice: Subject to any disclaimer, the term of this patent is extended or adjusted under 35 U.S.C. 154(b) by 0 days.

(21) Appl. No.: 11/426,180

(22) Filed: Jun. 23, 2006

(65) Prior Publication Data

US 2007/0295841 A1 Dec. 27, 2007

(51) Int. Cl.

| | |
|---|---|
| ***B05B 5/00*** | (2006.01) |
| ***F23D 11/32*** | (2006.01) |
| ***B05B 1/28*** | (2006.01) |
| ***A62C 31/02*** | (2006.01) |
| ***B05B 1/26*** | (2006.01) |

(52) U.S. Cl.
USPC ..... 239/690; 239/299; 239/601

(58) Field of Classification Search
USPC ..... 239/433, 444, 690–708, 601, 598, 298, 239/299, 760; 118/300
See application file for complete search history.

(56) References Cited

U.S. PATENT DOCUMENTS

| | | | | |
|---|---|---|---|---|
| 2,778,688 | A * | 1/1957 | Corl | 239/601 |
| 3,198,442 | A * | 8/1965 | Brenner | 239/601 |
| 3,261,558 | A * | 7/1966 | Davies | 239/265.11 |
| 3,314,611 | A * | 4/1967 | McCartney et al. | 239/424 |
| 3,737,108 | A * | 6/1973 | Stumphauzer et al. | 239/598 |
| 3,886,565 | A * | 5/1975 | Kojima | 347/47 |
| 4,664,315 | A * | 5/1987 | Parmentar et al. | 239/706 |
| 4,749,125 | A * | 6/1988 | Escallon et al. | 239/3 |
| 4,798,338 | A * | 1/1989 | Bauch et al. | 239/692 |
| 5,165,601 | A * | 11/1992 | Rodenberger et al. | 239/3 |
| 5,332,154 | A * | 7/1994 | Maier et al. | 239/3 |
| 5,400,975 | A * | 3/1995 | Inculet et al. | 239/690.1 |
| 6,206,963 | B1 * | 3/2001 | Abrahams | 118/300 |
| 6,254,684 | B1 * | 7/2001 | Borner et al. | 118/629 |

(Continued)

FOREIGN PATENT DOCUMENTS

| | | |
|---|---|---|
| WO | WO-2008002437 A2 | 1/2008 |
| WO | WO-2008002437 A3 | 1/2008 |

OTHER PUBLICATIONS

"International Application Serial No. PCT/US2007/014406, Search Report mailed Jul. 11, 2008", P220, 6 pgs.

(Continued)

*Primary Examiner* — Len Tran
*Assistant Examiner* — Chee-Chong Lee
(74) *Attorney, Agent, or Firm* — Billion & Armitage; Benjamin C. Armitage

(57) ABSTRACT

Embodiments of the invention relate to a nozzle assembly for electrostatic deposition comprising a single point nozzle, the single point nozzle being conically shaped and including an apex and a circular base, the circular base including a smaller diameter cylindrical protrusion including a counter bore which connects to a passage leading to the apex; and a nozzle body, in contact with the single point nozzle and including a first through bore, a larger second through bore and a cross drilled port into the first through bore; and a cylindrical electrode, at least partially inserted within the first through bore of the nozzle body and in contact with the counter bore of the single point nozzle, the electrode including a bore mating aligned with the cross drilled port of the nozzle body, and inlets positioned at either end.

23 Claims, 7 Drawing Sheets

(56) References Cited

U.S. PATENT DOCUMENTS

| | | | | |
|---|---|---|---|---|
| 6,467,705 | B2 * | 10/2002 | Robidoux | 239/697 |
| 6,845,748 | B2 * | 1/2005 | Kobayashi et al. | 123/305 |
| 2004/0251327 | A1 * | 12/2004 | Messerly et al. | 239/690.1 |

OTHER PUBLICATIONS

"International Application Serial No. PCT/US2007/014406, Written Opinion mailed Jul. 11, 2008", P237, 3 pgs.

* cited by examiner

NOZZLE ASSEMBLY AND METHODS RELATED THERETO

TECHNICAL FIELD

Embodiments of the present invention relate to a nozzle assembly. More specifically, the embodiments relate to a nozzle assembly for electrostatic deposition.

BACKGROUND

Linear nozzles for electrostatic deposition have been used to apply nonconductive materials to a target (substrate). Typically, these substrates consist of dimensions exceeding several inches. In some coated products, the substrate is much smaller than a span of several inches. Single point nozzles greatly improved the ability to apply highly charged material to smaller objects with the same precise control as a linear nozzle.

As more demanding material applications are presented, the need for more precision and consistency in spraying smaller objects becomes a priority. In using a single point nozzle, there are many physical variables that are difficult to control. One challenge in using a single point nozzle is using low flow rates. At low flow rates, the evaporative characteristics of the fluid become very important, as sealing issues create inconsistent viscosities and therefore, poorer process control.

Many single point nozzles are manufactured using split-half construction, which allows for leakage or blockage of the fluid passage. Sealing is necessary when solvented materials are applied, but persistent small leakages between the split-halves causes uncontrollable increases in concentrations of the fluid being deposited. Current materials in constructing a single point nozzle, including acetal or polyether ether ketone (PEEK), are difficult to machine at the precise levels needed for a consistent nozzle tip. With a split design, it is difficult to align the halves and maintain consistency in the spraying.

The sharpness and symmetry of the tip is critical to the formation of the most optimal meniscus and the lowest firing voltage. Using current materials and construction methods, durability and consistent symmetry of the tip is a challenge. Further, a thin electrode is often positioned between the split-halves and makes for an additional component to properly align between uses and after cleaning.

BRIEF DESCRIPTION OF THE DRAWINGS

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

SUMMARY

Figure 1:
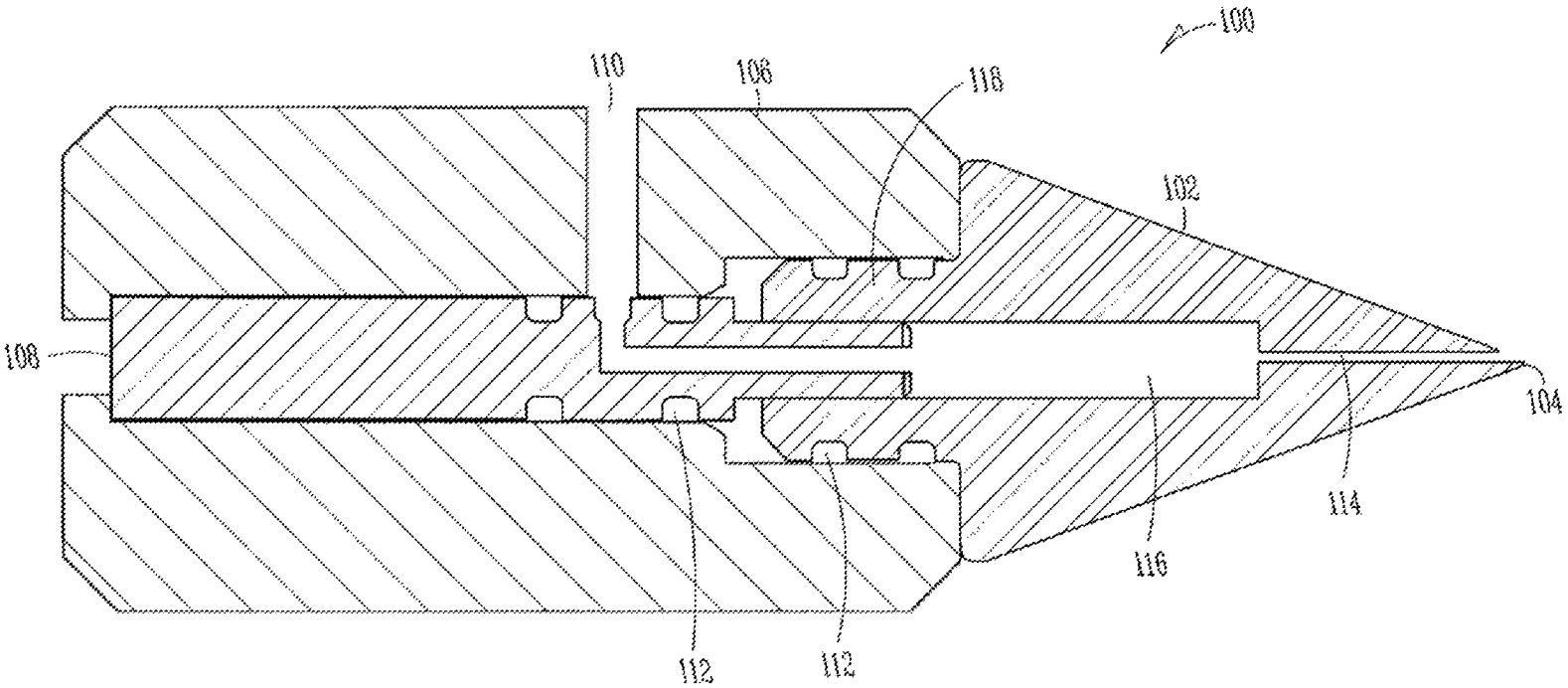
FIG. 1 illustrates a cross-sectional view of a nozzle assembly, according to some embodiments.

Embodiments of the invention relate to a nozzle assembly for electrostatic deposition comprising a single point nozzle, the single point nozzle being conically shaped and including an apex and a circular base, the circular base including a smaller diameter cylindrical protrusion including a counter bore which connects to a passage leading to the apex, the apex including a precision ground flat; and a nozzle body, in contact with the single point nozzle and including a first through bore, a larger second through bore and a cross drilled port into the first through bore; and a cylindrical electrode, at least partially inserted within the first through bore of the nozzle body and in contact with the counter bore of the single point nozzle, the electrode including a bore mating aligned with the cross drilled port of the nozzle body, and inlets positioned at either end; and wherein the cross drilled port of the nozzle body, the bore mating of the electrode and the passage of the single point nozzle create a fluid channel to the apex of the single point nozzle.

Embodiments also relate to a method of manufacturing a nozzle assembly for electrostatic deposition. The method comprises forming a single point nozzle, the single point nozzle being conically shaped and including an apex and a circular base, the circular base including a smaller diameter cylindrical protrusion including a counter bore which connects to a passage leading to the apex, the apex including a precision ground flat; forming a nozzle body, including a first through bore, a larger second through bore and a cross drilled port into the first through bore; forming a cylindrical electrode, the electrode including a bore mating and inlets positioned at either end; contacting the cylindrical electrode with the nozzle body; and contacting the cylindrical electrode and nozzle body with the single point nozzle; wherein the cross drilled port of the nozzle body, the bore mating of the electrode and the passage of the single point nozzle create a fluid channel to the apex of the single point nozzle.

Embodiments also relate to methods of using a nozzle assembly.

DETAILED DESCRIPTION

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

In this document, the terms "a" or "an" are used to include one or more than one and the term "or" is used to refer to a nonexclusive or unless otherwise indicated. In addition, it is to be understood that the phraseology or terminology employed herein, and not otherwise defined, is for the purpose of description only and not of limitation. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

Embodiments of the invention relate to a nozzle assembly for electrostatic deposition, which includes fiberspinning, nanoparticle production or spraying of an electrically charged fluid. The nozzle assembly embodiments allow for consistent and accurate electrostatic deposition of material at extremely low flow rates, such as under 2 ml/hr, for example. The construction of the nozzle assembly allows for easy cleaning and consistent assembly. The nozzle assembly embodiments are free of chemical sealants and greatly reduce or eliminate the effects of leakage. The durability and precision of the single point nozzle tip (or apex) have been greatly increased due to construction methods and materials. The use of a vapor housing body surrounding the nozzle assembly enables spraying of highly concentrated materials at lower solvent percentage than previously possible.

Referring to FIG. 1, a cross-sectional view of a nozzle assembly 100 is shown, according to some embodiments. A single point nozzle 102 comprises a counter bore 116 adjacent to a passage 114 which leads to the apex 104. The apex 104 may be precision ground flat cut to create the desired meniscus size or geometry. The single point nozzle 102 further comprises a cylindrical protrusion 118 in which at least part of a cylindrical electrode 108 may be inserted. A nozzle body 106 may be in contact with both the electrode 108 and single point nozzle 102. Optional grooves 112 on both the single point nozzle 102 and electrode 108 may comprise O-rings or other physical sealers in order to seal the components from fluid leakage. A fluid channel 110 may be created by the alignment of the components, which leads to the apex 104. The nozzle assembly 100 allows for simple assembling, disassembling and cleaning. The use of O-rings instead of sealers reduces or eliminates leakage.

Figure 2A:
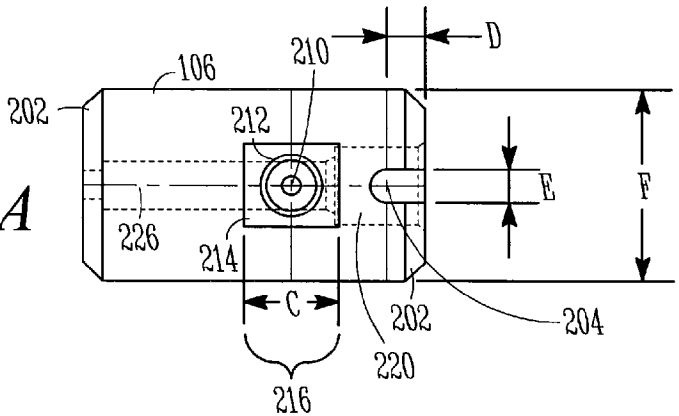
FIG. 2A illustrates a perspective view of a nozzle body, according to some embodiments.
Figure 2B:
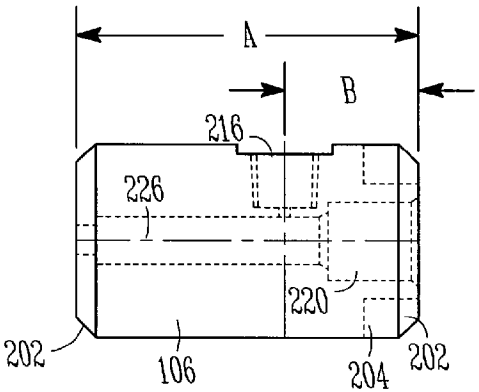
FIG. 2B illustrates a perspective view of a rotated nozzle body, according to some embodiments.

Referring to FIGS. 2A-D, perspective views of a nozzle body 106 are shown, according to some embodiments. In FIG. 2A, the nozzle body 106, which may be cylindrical, comprises a cross drilled port 216. The cross drilled port 216 may include threads 212 and a cut-out 214, which allows for a secure fit for a fluid inlet line or reservoir. The cross drilled port 216 further comprises an inlet hole 210 for passing a fluid. The end edges 202 may be beveled. One or more slots 204 may be used to secure the nozzle body on a mount, for removing components or for coupling with additional components, such as a vapor housing body. The shadowed chambers represent interior through bore 226 and larger second through bore 220. Measurement "C" may be about 0.3 to about 1.0 inches, for example. Measurement "D" may be about 0.1 to about 0.4 inches, for example. Measurement "E" may be 0.1 to about 0.3 inches, for example. Measurement "F" may be about 0.6 to about 1.8 inches, for example. The rotated view in FIG. 2B, shows more clearly the through bore 226 and larger second through bore 220. The cross drilled port 216 connects to the through bore 226 perpendicular to the centerline of the nozzle body 106. The through bore 226 receives and positions the electrode 108. The second larger through bore 220 receives the cylindrical protrusion 118 or the single point nozzle 102, as it fits over the electrode 108. Measurement "A" may be about 1.1 to about 3.3 inches, for example. Measurement "B" may be about 0.4 to about 1.2 inches, for example.

Figure 2D:
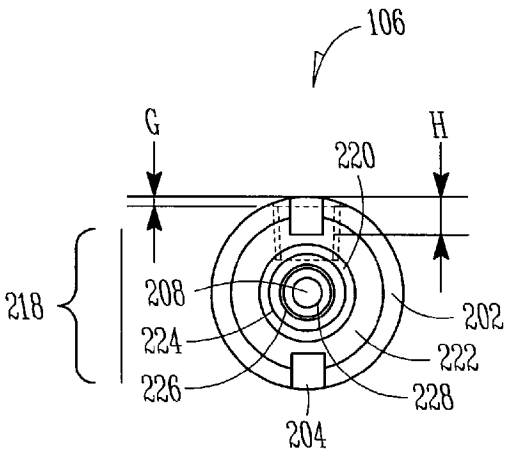
FIG. 2D illustrates a perspective front view of a nozzle body, according to some embodiments.
Figure 2C:
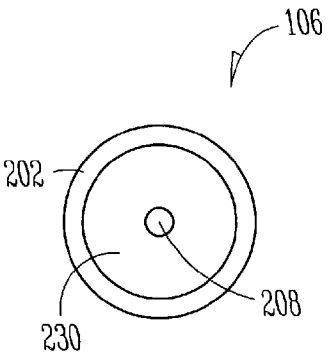
FIG. 2C illustrates a perspective rear view of a nozzle body, according to some embodiments.

Referring to FIG. 2C, a rear view of the nozzle body 106 is shown, according to some embodiments. The rear surface 230 comprises an inlet 208 which allows for electrical access to the electrode 108 positioned within. The end edge 202 may also be optionally beveled. The front view of the nozzle body 106 is shown in FIG. 2D, according to some embodiments. The front surface 222 comprises the end edge 202, optional slots 204 and electrode opening 218. The electrode opening 218 comprises the second through bore 220, the second through bore inner edge 224, the through bore 226, the through bore inner edge 228 and inlet 208. Measurement "G" may be about 0.03 to about 0.09 inches, for example. Measurement "H" may be about 0.1 to about 0.3 inches, for example.

Figure 3A:
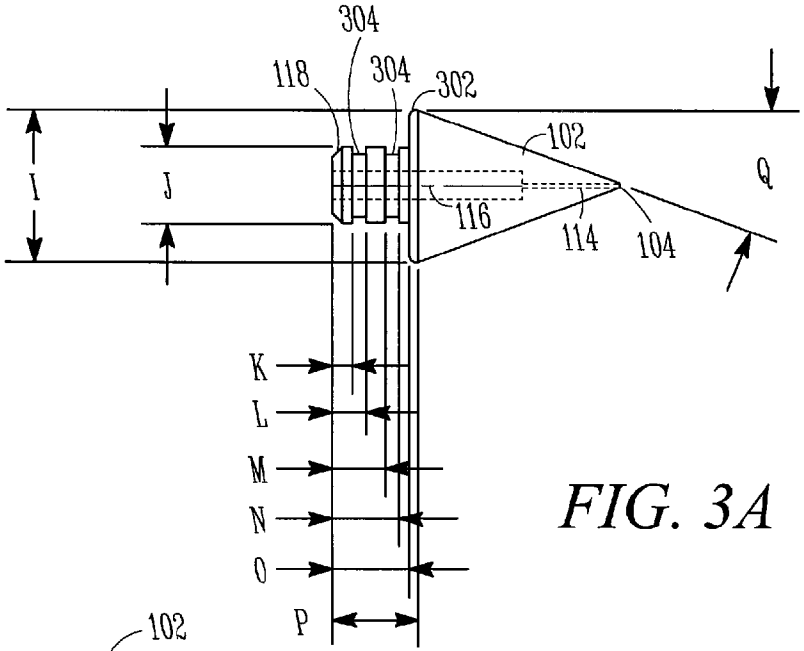
FIG. 3A illustrates a perspective view of a single point nozzle, according to some embodiments.
Figure 3B:
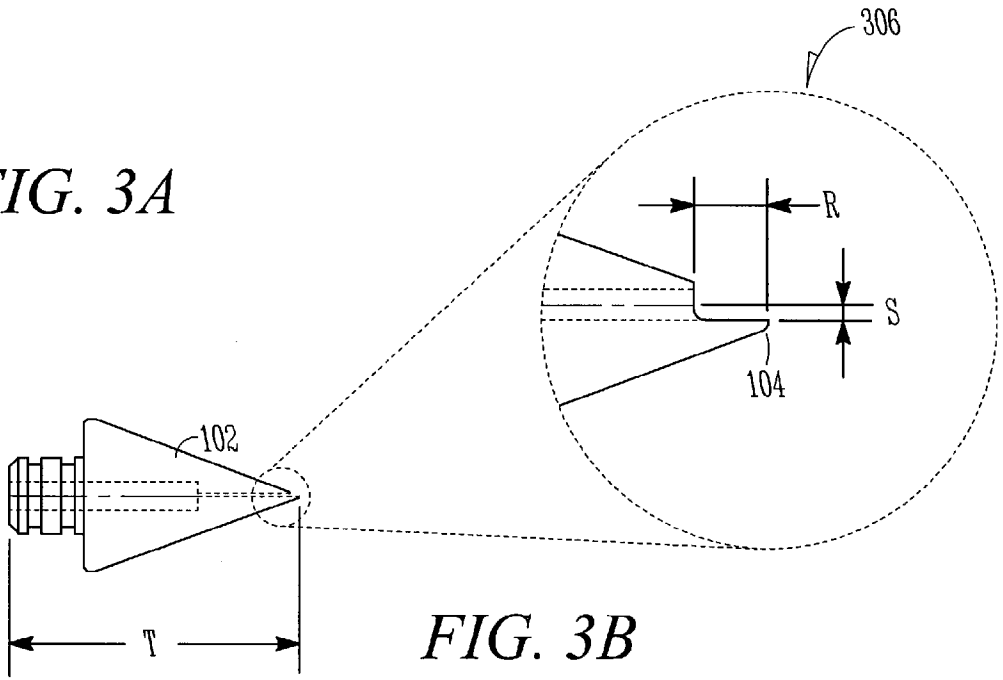
FIG. 3B illustrates a perspective view of a single point nozzle with an enlarged view of the nozzle tip, according to some embodiments.
Figure 3C:
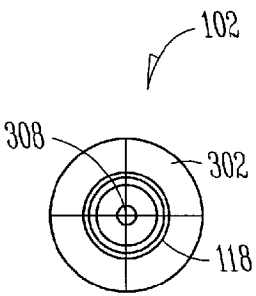
FIG. 3C illustrates a perspective rear view of a single point nozzle, according to some embodiments.

Referring to FIGS. 3A-C, perspective views of a single point nozzle 102 are shown, according to some embodiments. The single point nozzle 102, as shown in FIG. 3A, comprises a base 302, apex 104 and cylindrical protrusion 118. The single point nozzle 102 is therefore, of conical geometry. The cylindrical protrusion 118 may comprise grooves 304 that may hold O-rings used to seal the coupling of the single point nozzle 102 with the nozzle body 106. Shown in shadow are the interior counter bore 116 and passage 114. The counter bore 116 may receive the electrode 108. The counter bore 116 allows for the electrode 108 to get very close to the nozzle apex 104. Measurement "I" may be about 0.5 to about 1.5 inches, for example. Measurement "J" may be about 0.25 to about 0.75 inches, for example. Measurement "K" may be about 0.06 to about 0.18 inches, for example. Measurement "L" may be about 0.1 to about 0.3 inches, for example. Measurement "M" may be about 0.17 to about 0.51 inches, for example. Measurement "N" may be about 0.2 to about 0.6 inches, for example. Measurement "O" may be about 0.25 to about 0.75 inches, for example. Measurement "P" may be about 0.28 to about 0.84 inches, for example.

An expanded view 306 of the apex 104 is shown in FIG. 3B. The apex 104 may be offset by a precision ground flat, cut perpendicular to the centerline. The length of the precision ground flat may vary based on the material being deposited and the diameter of the passage 114 may vary according to the length of the precision ground flat. Measurement "R" (called the setback) and "S" may be varied to create the desired meniscus geometry for differing deposition needs. Measurement "R" (the setback) may be about 0.01 to about 0.12 inches, about 0.02 to about 0.08 inches, about 0.03 to about 0.07 inches, or less than about 0.05 inches, for example. Measurement "S" may be about 0.001 to about 0.02 inches, about 0.005 to about 0.015 inches, about 0.008 to about 0.012 inches, or less than about 0.01 inches, for example. Measurement "T" may be about 0.9 to about 3.0 inches, for example. Further, angle "Q", shown in FIG. 3A, represents the conical angle that may also be varied to create the desired deposition characteristics. Angle "Q" may be about 5 to about 40 degrees, for example. Angle "Q" may be about 10 to about 30 degrees, about 15 to about 25 degrees or about 20 degrees, for example. A rear view is shown in FIG. 3C, according to some embodiments. The base 302 comprises the cylindrical protrusion 118. The counter bore opening 308 is also shown.

Figure 4B:
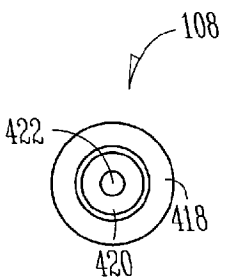
FIG. 4B illustrates a perspective rear view of an electrode, according to some embodiments.
Figure 4A:
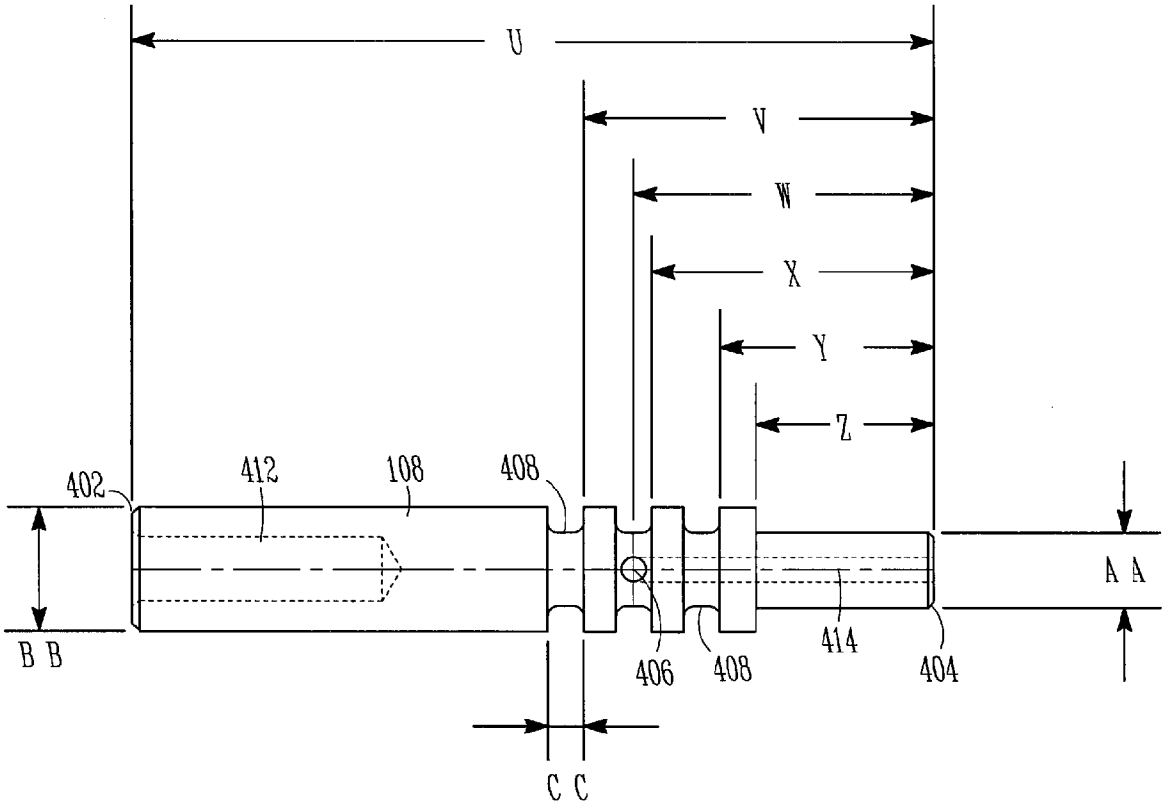
FIG. 4A illustrates a perspective view of an electrode, according to some embodiments.
Figure 4C:
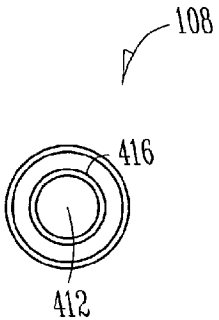
FIG. 4C illustrates a perspective front view of an electrode, according to some embodiments.

Referring to FIGS. 4A-C, perspective views of an electrode 108 are shown, according to some embodiments. In FIG. 4A, the electrode 108 comprises a front end 404, which surrounds the shadowed fluid passage 414. The cross drilled bore or bore mating 406 acts as a fluid inlet and may be aligned with the cross drilled port 216 of the nozzle body, which then connects with the passage 114 and exits through the apex 104, creating a fluid channel. The counter bore 116 of the single point nozzle 102 may also be part of the fluid channel. Grooves 408 may hold O-rings or other physical sealers, such as a gasket. Rear end 402 surrounds a counter bore 412, which may be used for electrical connection. Measurement "U" may be about 1.0 to about 3.0 inches, for example. Measurement "V" may be 0.44 to about 1.32 inches, for example. Measurement "W" may be about 0.37 to about 1.12 inches, for example. Measurement "X" may be about 0.35 to about 1.05 inches, for example. Measurement "Y" may be about 0.26 to about 0.8 inches, for example. Measurement "Z" may be about 0.22 to about 0.66 inches, for example. Measurement "AA" may be about 0.09 to about 0.27 inches, for example. Measurement "BB" may be about 0.15 to about 0.45 inches, for example. Measurement "CC" may be about 0.045 to about 0.135 inches, for example.

In FIG. 4B, a front view is shown, in which a fluid outlet 422 is surrounded by the front end surface 420 and larger front surface 418 of the rear end 402. In FIG. 4C, counter bore 412 may be used for electrical connection and is surrounded by rear end front surface 416.

Figure 5A:
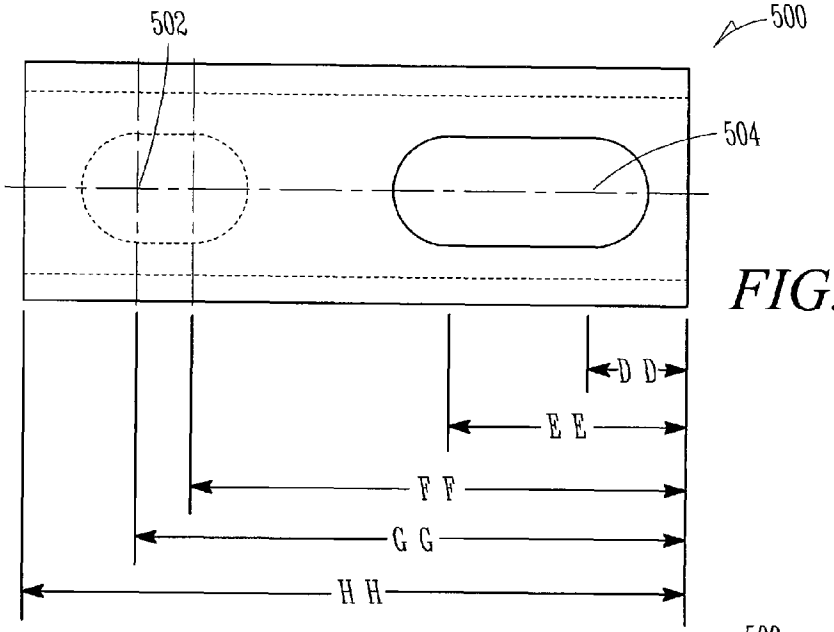
FIG. 5A illustrates a perspective view of a vapor housing body, according to some embodiments.
Figure 5B:
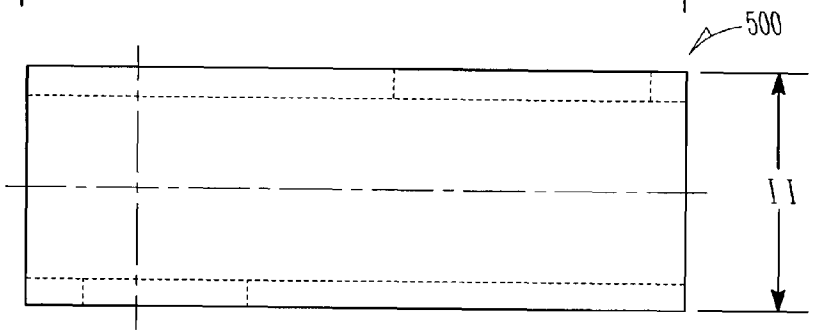
FIG. 5B illustrates a perspective rotated view of a vapor housing body, according to some embodiments.
Figure 5C:
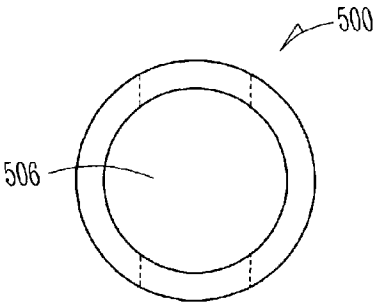
FIG. 5C illustrates a perspective rear view of a vapor housing body, according to some embodiments.

Referring to FIGS. 5A-C, perspective views of a vapor housing body 500 are shown, according to some embodiments. In FIGS. 5A-5B, the vapor housing body 500 may comprise optional slots 502 or transparent windows 504 for mounting and viewing, respectively. Measurement "DD" may be about 0.31 to about 0.93 inches, for example. Measurement "EE" may be about 0.8 to about 2.4 inches, for example. Measurement "FF" may be about 2.2 inches to about 4.4 inches, for example. Measurement "GG" may be about 1.9 to about 5.7 inches, for example. Measurement "HH" may be about 2.25 inches to about 6.75 inches, for example. Measurement "II" may be about 0.8 to about 2.4 inches, for example.

In FIG. 5C, the circular opening 506 surrounds the single point nozzle. The vapor housing body 500 may be especially useful when spraying highly concentrated materials. The vapor housing body 500 entraps the evaporating solvent from not only the meniscus (at the apex), but also at least partially from the jetting and dropletization off the apex. The vapor pressure of the solvent is then increased in the meniscus region, thereby slowing the diffusion of the solvent particles from the meniscus surface. As a result, a more concentrated mixture can be sprayed to produce a more efficient, and rapid coating, with less solvent pollution.

Depending on the manufacturing materials chosen, the vapor housing body 500 can also pick up a like electrical charge as the deposition material, due to air ionization from the nozzle tip (apex) and its fluid jet. Extending the vapor housing body 500 downward toward the target substrate further assists in entrapping solvent vapor from the meniscus to the targeting region, but can also be used to narrow the deposition pattern on the substrate due to the like-charged electrical field from the apex to the substrate.

Figure 6A:
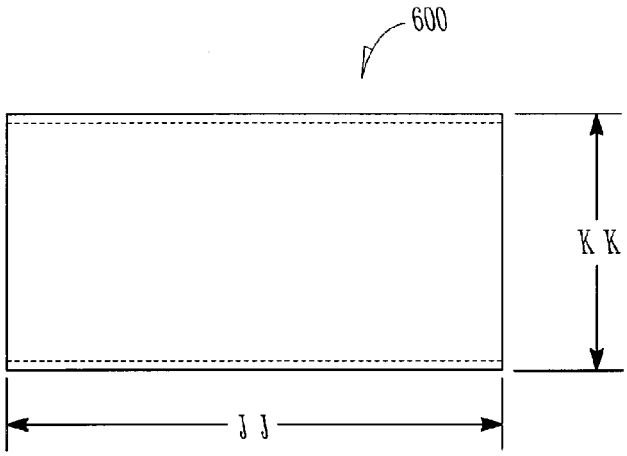
FIG. 6A illustrates a perspective view of a vapor housing cover, according to some embodiments.
Figure 6B:
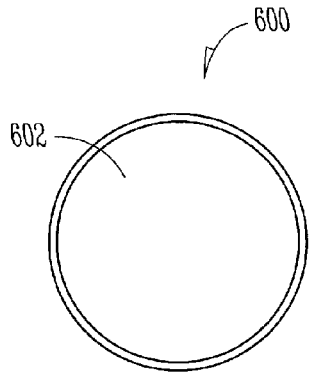
FIG. 6B illustrates a perspective rear view of a vapor housing cover, according to some embodiments.

Referring to FIGS. 6A-B, perspective views of a vapor housing cover 600 are shown, according to some embodiments. The vapor housing cover 600 may be cylindrical and surround the vapor housing body 500. The vapor housing cover 600 may be transparent and optionally placed over the vapor housing body 500 in order to view within the vapor housing body 500 and prevent any leakage from optional slots 502 or windows 504. In FIG. 6B, the circular opening 602 surrounds the vapor housing body 500. Measurement "JJ" may be about 2.2 to about 4.4 inches, for example. Measurement "KK" may be about 0.9 to about 2.7 inches, for example.

Figure 7:
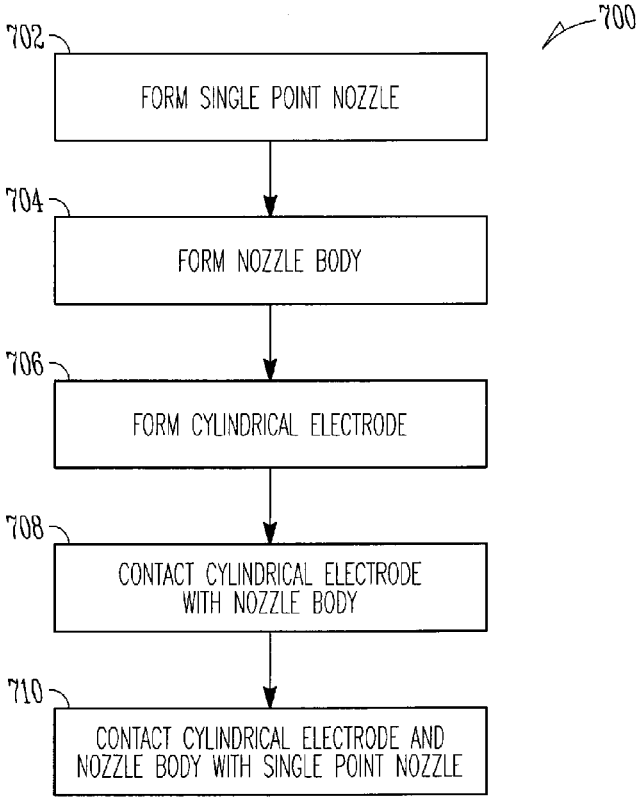
FIG. 7 illustrates a block flow diagram of a method of manufacturing a nozzle assembly, according to some embodiments.

Referring to FIG. 7, a block flow diagram of a method 700 to manufacture a nozzle assembly is shown, according to some embodiments. A single point nozzle may be formed 702. The single point nozzle may be formed 702 as one-piece construction. An example material may be a ceramic, such as zirconia. By choosing a "hard" material, the durability of the apex may be extended. Further, any damage to the apex may be readily detected, as compared to a softer plastic that may merely deflect at the apex.

A nozzle body may be formed 704. The nozzle body does not directly affect the spray pattern of the nozzle assembly and may then be manufactured of a nonconductive material, such as acetal, PEEK or a ceramic. A cylindrical electrode 706 may be formed. The cylindrical electrode may be formed 706 of a conductive material, such as stainless steel.

The cylindrical electrode may then be contacted 708 with the nozzle body. The cylindrical electrode and nozzle body may then be contacted 710 with the single point nozzle, to create the nozzle assembly.

In addition, an optional vapor housing body and optional vapor housing cover may be formed. The vapor housing body may be coupled to the single point nozzle. The vapor housing body may be formed of a solvent-resistant plastic, such as acetal. A transparent window may be formed in the vapor housing body and may be comprised of polycarbonate, for example.

Figure 8:
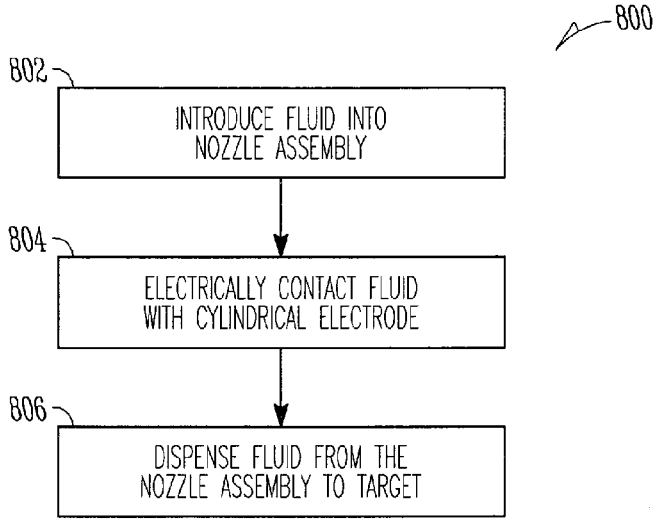
FIG. 8 illustrates a block flow diagram of a method of using a nozzle assembly, according to some embodiments.

Referring to FIG. 8, a block flow diagram of a method 800 of using a nozzle assembly is shown, according to some embodiments. A fluid may be introduced 802 to a nozzle assembly. The fluid may then be electrically contacted 804 with the cylindrical electrode. The fluid may next be dispensed 806 from the nozzle assembly to a target substrate. Target substrates for electrostatic deposition may be an almost unlimited amount of materials, so long as they have the capacity for grounding and enough surface conductivity to allow for electrostatic deposition. Examples of target substrates may be polymers, metals, wood, paper, etc.

Figure 9:
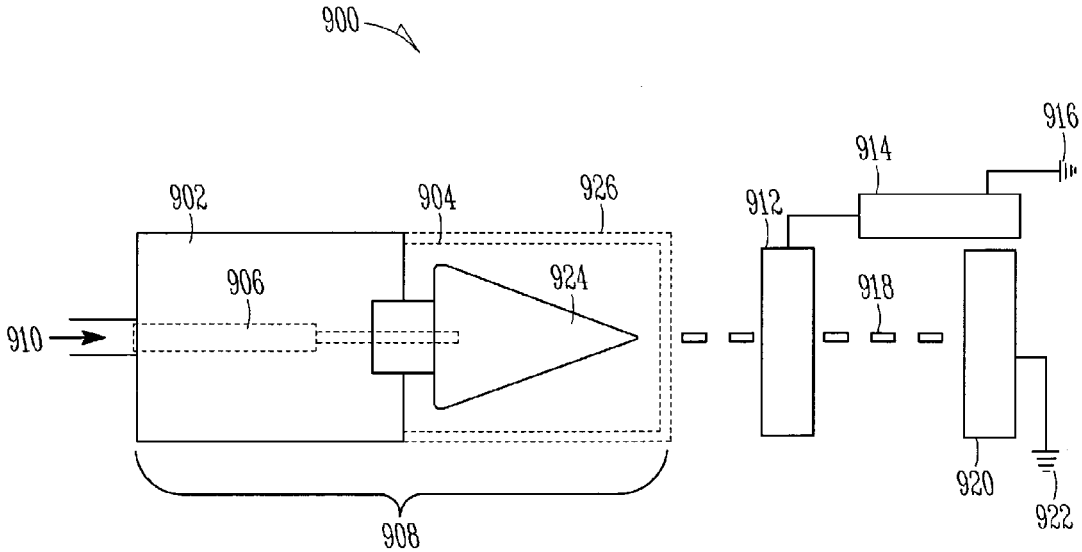
FIG. 9 illustrates a perspective view of electrostatic deposition utilizing a nozzle assembly, according to some embodiments.

Referring to FIG. 9, a perspective view of electrostatic deposition 900 utilizing a nozzle assembly is shown, according to some embodiments. A nozzle assembly 908, comprising a single point nozzle 924, nozzle body 902 and cylindrical electrode 906 may be utilized to electrostatically deposit a fluid 918 onto a target 920. The nozzle assembly 908 may optionally comprise a vapor housing body 904 and vapor housing cover 926. The nozzle assembly 908 may be coupled 910 to such components as a high voltage power supply, fluid reservoir, hydrostatic device, etc. in order to eject the fluid 918.

An optional configuration may be to utilize an inductor ring 912 in which the fluid 918 passes through, grounded 916 through a resistor/capacitor/inductor network 914. The target must be grounded 922. The inductor ring 912 may serve to intensify the local electrical field at the apex, thus reducing the firing voltage of the nozzle. The presence of the inductor ring 912 may also lessen the electric field from the nozzle at the substrate, producing a better coating on jagged or ornate substrate shapes. The inductor ring 912 may be utilized without the use of the optional vapor housing body 904 and optional vapor housing cover 926.

Embodiments of the present invention relate to a nozzle assembly that may accurately and precisely electrostatically deposit fluid at a flow rate of about 4 ml/hr or less, about 3 ml/hr or less, about 2 ml/hr or less or about 1 ml/hr or less, for example.

The Abstract is provided to comply with 37 C. F. R. §1.72 (b) to allow the reader to quickly ascertain the nature and gist of the technical disclosure. The Abstract is submitted with the understanding that it will not be used to interpret or limit the scope or meaning of the claims.

What is claimed is:

1. A nozzle assembly for electrostatic deposition of a charged fluid, comprising:

a single point nozzle, the single point nozzle being conically shaped and including an apex and a circular base, the circular base including a smaller diameter cylindrical protrusion including a counter bore which connects to a passage leading to the apex, the apex including a precision ground flat, cut perpendicular to a centerline of the apex for controlling meniscus size and reducing firing voltage;

a nozzle body, in contact with the single point nozzle and including a first through bore, a large second through bore and a cross drilled port into the first through bore; and a metal electrode at least partially inserted within the first through bore of the nozzle body and in contact with the counter bore of the single point nozzle, the electrode including a fluid passageway and a bore mating;

wherein the bore mating acts as a fluid inlet and is alignable with the cross drilled port of the nozzle body, and wherein the cross drilled port of the nozzle body, the bore mating of the electrode, the electrode fluid passageway, and the passage of the single point nozzle create a fluid channel for a charged fluid to pass to the apex of the single point nozzle, and the nozzle is configured to electrostatically deposit a fluid at a rate less than about 4 milliliters per hour.

2. The nozzle assembly of claim 1, further comprising a vapor housing body at least partially surrounding the single point nozzle.

3. The nozzle assembly of claim 1, wherein the nozzle body is cylindrical.

4. The nozzle assembly of claim 1, wherein the cylindrical protrusion comprises grooves capable of holding O-rings.

5. The nozzle assembly of claim 1, wherein the electrode further comprises grooves capable of holding O-rings.

6. The nozzle assembly of claim 1, wherein the single point nozzle is one-piece manufactured.

7. The nozzle assembly of claim 1, wherein the nozzle assembly is capable of spraying a target at less than about milliliters per hour flow rate.

8. The nozzle assembly of claim 1, wherein the single point nozzle comprises a ceramic.

9. The nozzle assembly of claim 1, wherein the single point nozzle comprises zirconia.

10. The nozzle assembly of claim 1, further comprising an inductor ring, positioned near the single point nozzle.

11. The nozzle assembly of claim 10, wherein the inductor ring is grounded through a network including one or more of a resistor, capacitor or inductor.

12. The nozzle assembly of claim 10, wherein the inductor ring reduces the firing voltage of the nozzle.

13. The nozzle assembly of claim 10, wherein the inductor ring lessens the electric field between the nozzle and target substrate.

14. A method of manufacturing a nozzle assembly for electrostatic deposition of a charged fluid, the method comprising:

forming a single point nozzle, the single point nozzle being conically shaped and including an apex and a circular base, the circular base including a smaller diameter cylindrical protrusion including a counter bore which connects to a passage leading to the apex, the apex including a precision ground flat, cut perpendicular to a centerline of the apex for controlling meniscus size and reducing firing voltage;

forming a nozzle body, including a first through bore, a large second through bore and a cross drilled port into the first through bore;

forming a cylindrical metal electrode, the electrode including a bore mating and a fluid passageway;

contacting the cylindrical electrode with the nozzle body; and contacting the cylindrical electrode and nozzle body with the single point nozzle;

wherein the cross drilled port of the nozzle body, the bore mating of the electrode, the electrode fluid passageway, and the passage of the single point nozzle create a fluid channel for a charged fluid to pass to the apex of the single point nozzle and the nozzle is configured to electrostatically deposit a fluid at a rate less than about 4 milliliters per hour.

15. The method of claim 14, wherein forming a single point nozzle comprises one-piece manufacturing.

16. The method of claim 14, wherein forming a single point nozzle comprises forming a ceramic single point nozzle.

17. The method of claim 14, wherein forming a single point nozzle comprises forming a zirconia single point nozzle.

18. The method of claim 14, further comprising forming a vapor housing body.

19. The method of claim 18, further comprising coupling the vapor housing body with the single point nozzle.

20. A method of using a nozzle assembly for electrostatic deposition of a charged fluid, the method comprising:

introducing a fluid into a nozzle assembly, the nozzle assembly comprising:

a single point nozzle, the single point nozzle being conically shaped and including an apex and a circular base, the circular base including a smaller diameter cylindrical protrusion including a counter bore which connects to a passage leading to the apex, the apex including a precision ground flat, cut perpendicular to a centerline of the apex for controlling meniscus size and reducing firing voltage;

a nozzle body, in contact with the single point nozzle and including a first through bore, a larger second through bore and a cross drilled port into the first through bore; and a metal electrode sealed at least partially inserted within the first through bore of the nozzle body and in contact with the counter bore of the single point nozzle, the electrode including a bore mating aligned with the cross drilled port of the nozzle body, and a fluid passageway;

wherein the cross drilled port of the nozzle body, the bore mating of the electrode, the electrode fluid passageway, and the passage of the single point nozzle create a fluid channel to the apex of the single point nozzle;

electrically contacting the fluid with the electrode; and dispensing the fluid from the nozzle assembly to a target at a rate less than about 4 milliliters per hour.

21. The method of claim 20, wherein the single point nozzle comprises a ceramic.

22. The method of claim 20, wherein the single point nozzle comprises zirconia.

23. The method of claim 20, wherein a single point nozzle is one-piece manufactured.

* * * * *